United States Patent [19]

Dana et al.

[11] Patent Number: 4,993,784

[45] **Date of Patent: * Feb. 19, 1991**

[54] LOCKING DEVICE

[75] Inventors: Merrill A. Dana, Millbury; August M. Boucher, Leominster, both of Mass.; Wayne Crepso, Troy, N.H.

[73] Assignee: Engineered Security Products Corporation, Leominster, Mass.

[ * ] Notice: The portion of the term of this patent subsequent to Aug. 8, 2006 has been disclaimed.

[21] Appl. No.: 281,106

[22] Filed: Dec. 7, 1988

[51] Int. Cl.[5] ..... E05C 7/06

[52] U.S. Cl. ..... 312/221

[58] Field of Search ..... 312/216–221

[56] References Cited

U.S. PATENT DOCUMENTS

| | | | |
|---|---|---|---|
| 4,711,505 | 12/1987 | Lasko | 312/221 X |
| 4,768,844 | 9/1988 | Ludwig | 312/221 |
| 4,776,476 | 9/1988 | Lasko | 312/221 X |
| 4,854,653 | 8/1989 | Lasko | 312/221 |

*Primary Examiner*—Joseph Falk

*Attorney, Agent, or Firm*—Joseph S. Iandiorio; Brian M. Dingman

[57] ABSTRACT

A locking device including a plurality of small, discrete elements and means for confining the elements in a string. Further included are primary and secondary biasing means at opposite ends of the string for biasing the elements into a contiguous series with each adjacent pair meeting at a junction. The locking device also has a plurality of actuator means. Each of the actuator means in an unlocked state is poised adjacent a junction, and is movable from the unlocked state to a locked state in which it is interjected into its adjacent junction for shifting the remainder of the elements against the force of the biasing means to misalign all of the remaining junctions with respect to their associated actuators and prevent the remaining actuators from moving to the locked state. The biasing means returns all the elements to the contiguous series when the actuator means in the locked state is returned to the unlocked state. Further included are means for realigning an element junction with each of the actuator means to allow any of the actuator means to be moved to the locked state.

23 Claims, 5 Drawing Sheets

LOCKING DEVICE

FIELD OF INVENTION

This invention relates to a locking device and more particularly to a multiple-drawer locking device which allows only one drawer to be open at a time and which can be locked to prevent any of the drawers from being opened.

BACKGROUND OF INVENTION

In drawer-locking devices employing a string of elements, the structure that provides the means for locking all of the drawers typically moves the entire string of elements. However, the string is moved a relatively small distance. With wear from repeated use, and extreme cooling and/or heating, enough play can develop in the string to interfere with the multiple locking function of the locking device. The conventional rotary multiple drawer locking devices used to move the entire string have a limited maximum string displacement due to their rotary action. Consequently, they can not in all instances supply the amount of string movement needed to obviate this interference problem.

An additional problem with these drawer-locking devices is that they can only work as long as a junction of string elements lies adjacent the element being thrust into the string. If all of the elements are not returned to their original positions after an open drawer is closed, one or more of the drawers may remain locked.

There also exists the possibility that an oscillatible actuator driver in the drawer-open position could be jostled back to its drawer-closed position by movement of the cabinet. Since the open drawers can interlock only with a properly positioned actuator driver, if this happened the open drawer could not be fully closed.

SUMMARY OF INVENTION

It is therefore an object of this invention to provide a locking device in which the amount of string movement on multiple drawer locking is greatly increased.

It is a further object of this invention to provide a locking device in which the elements are positively returned to the same position after each locking/unlocking cycle.

It is a further object of this invention to provide a locking device in which the oscillatible actuator driver is positively held in its locking position.

This invention results from the realizations that locking devices can be greatly improved by: ensuring that the string elements return to exactly the same position after each locking/unlocking cycle; increasing the amount of string movement on multiple drawer locking; and positively holding the locking actuators in their locking positions.

This invention features a locking device including a plurality of small, discrete elements and means for confining the elements in a string. Primary and secondary biasing means are included at opposite ends of the string for biasing the elements into a contiguous series with each adjacent pair meeting at a junction. The locking device further includes a plurality of actuator means. Each actuator means has a first, unlocked state poised adjacent a junction and a second locked state interjected into its adjacent junction for shifting the remainder of the elements against the force of the biasing means to misalign all of the remaining junctions with respect to their associated actuators and prevent the remaining actuators from moving to the locked state. The biasing means return all of the elements to the contiguous series when the interjected actuator means is returned to the unlocked state. The locking device further includes means for realigning an element junction with each of the actuator means to allow them to be moved to the locked state.

In a preferred embodiment, the biasing means includes primary and secondary axially compressible elements aligned with the string of elements. The primary compressible element is preferably more stiff in compression than the secondary compressible element. In that case, the secondary compressible element preferably exerts more biasing force on the string of elements than the primary compressible element when the elements are in the contiguous series. The means for realigning preferably includes a stop for fixing the position of the secondary compressible element when the string elements are in the contiguous series to positively return the junctions to alignment with the actuators.

In an alternative embodiment, the locking device further includes means for displacing the junctions adjacent the actuators so none of the actuators are aligned with an element junction to prevent any of the actuators from moving to the locked state. The means for displacing the junctions preferably includes means for displacing the primary biasing means toward the secondary biasing means. This may be accomplished with a rotary drive member disposed in the string proximate the primary biasing means. Driver means such as key controlled lock may then be included for rotating the drive member to selectively displace the primary biasing means. Preferably, the driver means is attached to the drive member by a flexible shaft which accounts for misalignment between it and the drive member.

In another alternative embodiment, the means for displacing the junctions adjacent the actuators includes a rotary drive member including a crescent-shaped member and a spherical element adjacent an element intersection proximate the primary biasing means. The crescent-shaped member preferably drives the spherical element between string elements when the drive member is rotated to displace the junctions adjacent the actuators.

In another alternative embodiment, the means for displacing the primary biasing means toward the secondary biasing means includes a drive member partially disposed in the string and projecting at an angle thereto. In that case, a shaft member disposed substantially perpendicularly to the string may be included for engaging the drive member. Further included may be means for displacing the shaft member toward the string. This may be accomplished with a key controlled lock proximate the end of the shaft member spaced from the drive member. The lock may be fixed or movable in relation to the shaft member.

Preferably, the locking device is employed as a drawer locking device which prevents the opening of more than one drawer in a multi-drawer structure. To accomplish this, the locking device may include an actuator drive member associated with each actuator. Each of the actuator drive members then couples a drawer to an actuator means for interjecting the actuator when the drawer is opened. The actuator drive members are preferably pivotally attached to the means for confining the string elements at spaced positions along the string. In that case, there may be further included biasing means for holding the actuator drive members in the locked position. The actuator drive members may include a bifurcated member; one arm engaging a drawer as it is opened and another arm engaging the drawer when it is closed.

DISCLOSURE OF PREFERRED EMBODIMENTS

Other objects, features and advantages will occur from the following description of preferred embodiments and the accompanying drawings, in which.

Figure 6A:
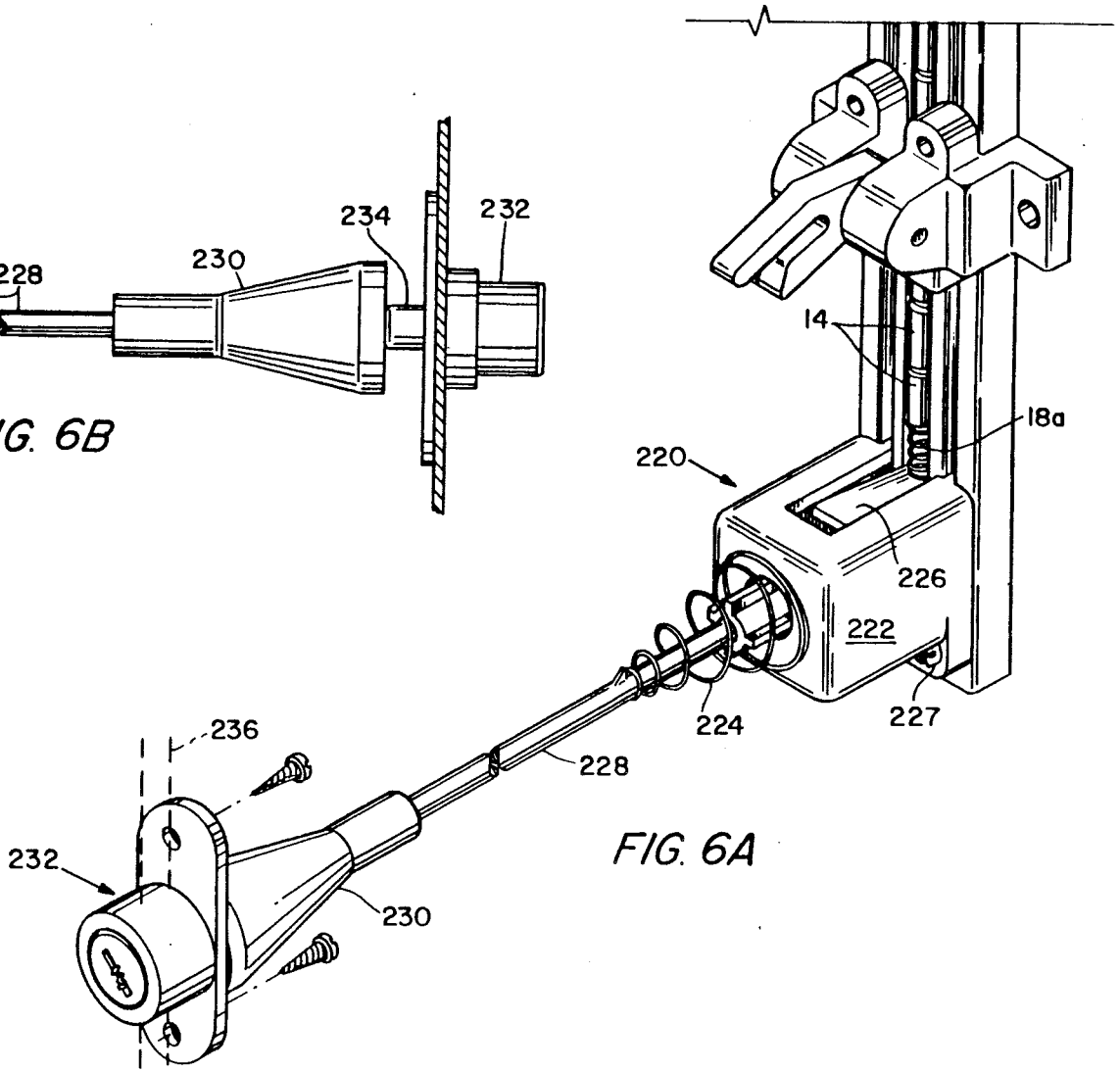
Figure 6B:
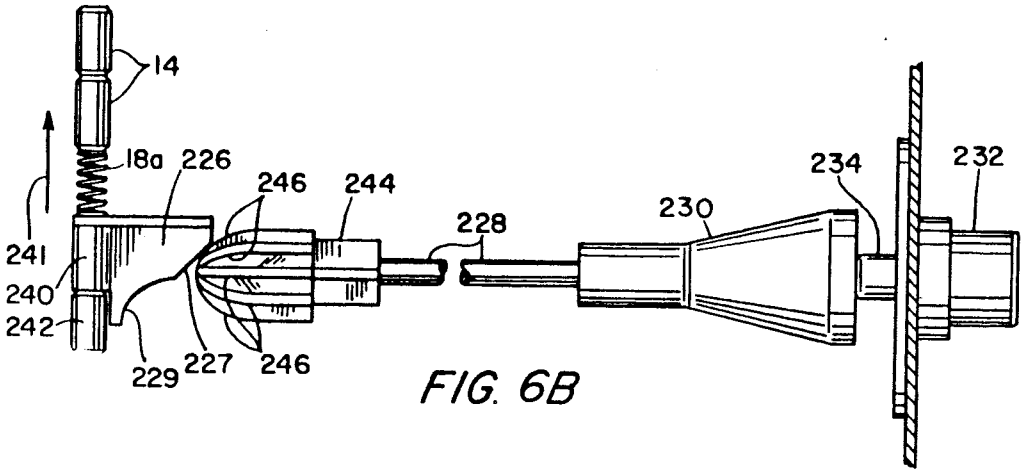
Figure 7B:
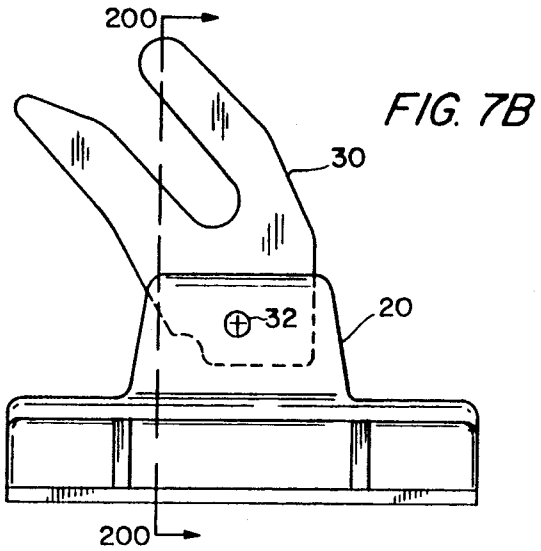
Figure 8B:
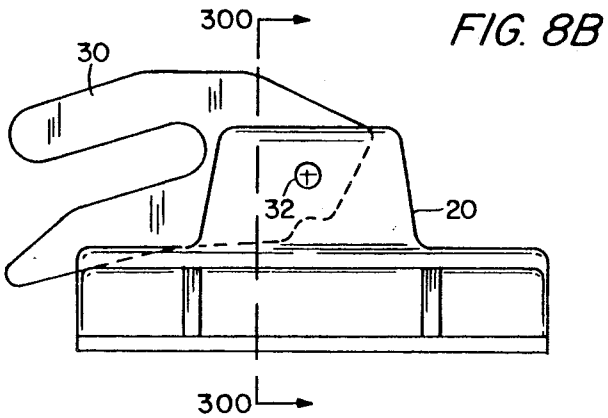
Figure 7A:
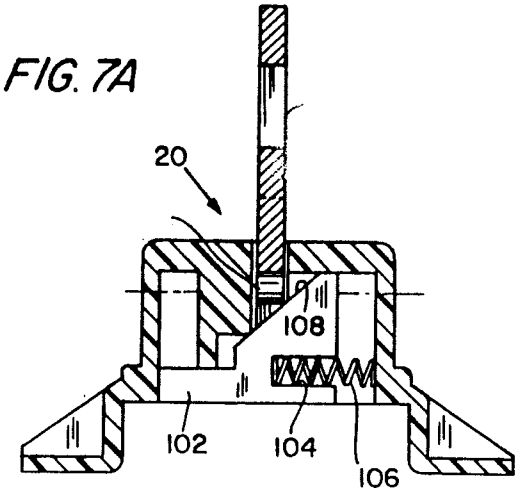
Figure 8A:
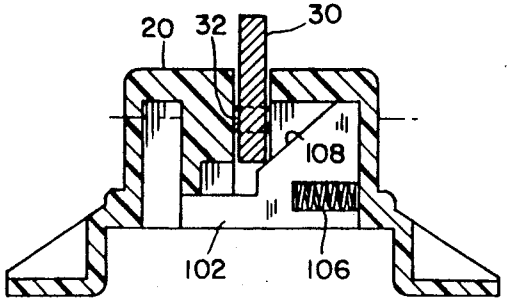

FIG. 6A an axonometric view of another embodiment of the multiple locking feature according to this invention;

FIG. 6B is an axonometric view of part of the multiple locking device of FIG. 6A;

FIGS. 7A and 8A are cross-sectional views taken along lines 200 and 300 of FIGS. 7B and 8B respectively showing the means for holding the actuator driver in the locking position, according to this invention; and FIGS. 7B and 8B are side elevational views of an actuator driver in the locking and unlocked positions, respectively.

Figure 1:
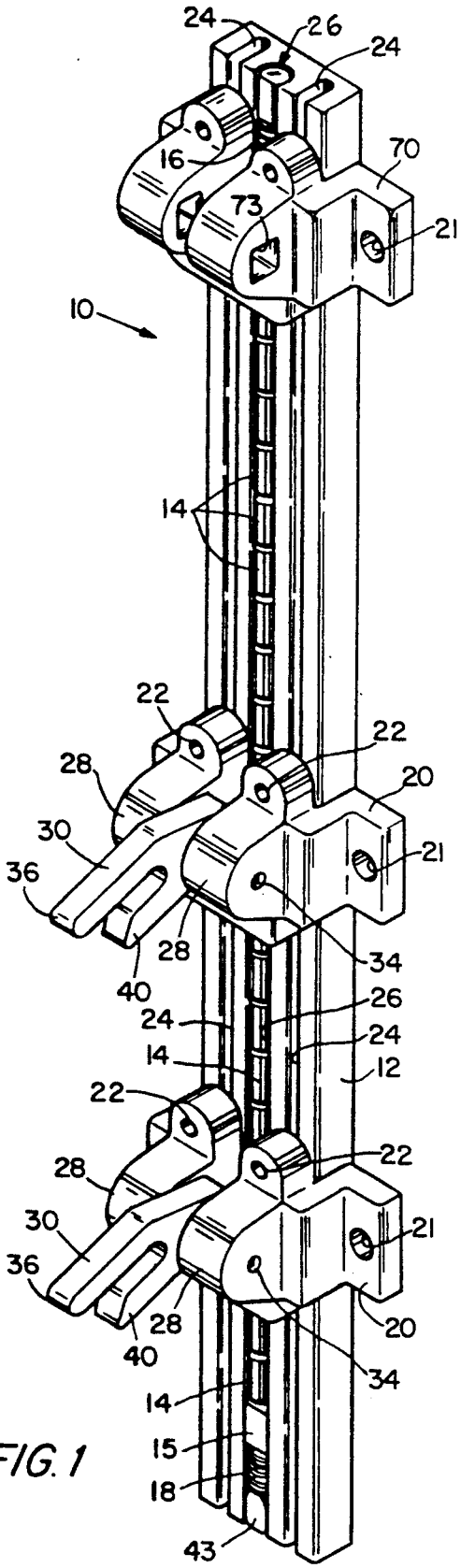
FIG. 1 is an axonometric view of a locking device according to this invention.
Figure 3A:
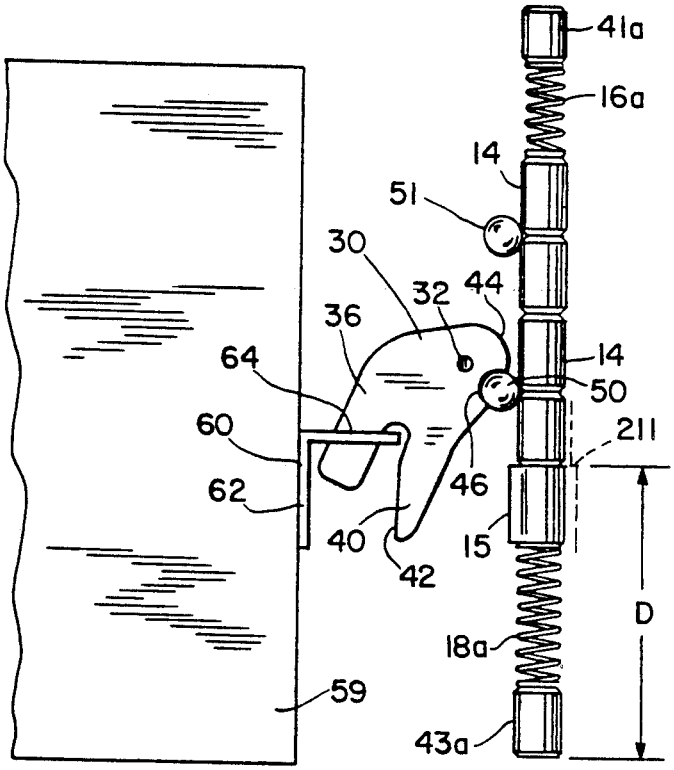
FIGS. 3A and 3B are diagrammatic side elevational views illustrating the locking function of the device of FIG. 1.
Figure 3B:
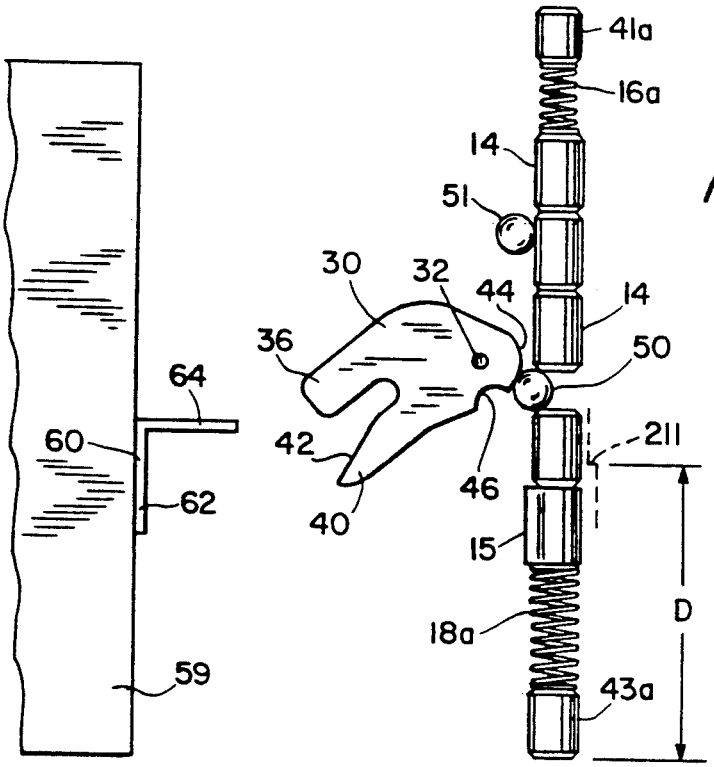

There is shown in FIG. 1 locking device 10 which may be employed, for example, to lock the drawers in a multi-drawer device such as a desk or file cabinet. The device may also be used for preventing more than one drawer in such a multi-drawer device from being open at a time. Locking device 10 includes a number of small, discrete elements 14. Elements 14 may have virtually any shape but are preferably cylindrical with tapered ends as shown in FIGS. 3A and 3B. Elements 14 are confined in partially open channel member 12. Channel member 12 may be an extruded aluminum channel or a formed, machined or molded plastic or metal channel having central partially open circular channel 26 for holding elements 14 and more narrow, u-shaped channels 24 for receiving mounting screws as explained below.

Spaced along channel 12 are actuator driver holders 20. Holders 20 are attached to channel 12 by screws or rivets, not shown, which pass through screw holes 22 into channels 24. Locking device 10 is attached to a structure such as a file cabinet by screws or rivets, not shown, passed through mounting holes 21, typically on the inside rear of the structure. Holders 20 may alternatively be designed for flush mounting by making them flat instead of L-shaped to bury member 12 in the wall of the file cabinet. Flush mounting is preferred where there is very little space behind the drawers for the locking device.

Actuator drivers 30 are pivotally attached to body 28 of holder 20 by a pin passed through mounting hole 34 as is described below. Actuator drivers 30 include first arm 36 and second arm 40 for engaging a device such as a drawer being locked as is more fully explained below.

Coil springs 16 and 18 are disposed at the ends of the string of elements 14 to bias the elements together into a contiguous condition when all of the actuators and actuator drivers are in the unlocked position, as is more fully described below. Positive return element 15 is disposed adjacent spring 18 for returning elements 14 to the same position after each locking-unlocking or interlocking cycle as is also more fully explained below. Element 15 is slightly larger than elements 14 and is fit in channel 26 by counterboring the channel to create a shoulder against which element 15 rests when the actuator drivers are in the unlocked position.

Multiple locking device holder 70 is attached to channel member 12 in the same manner as holding elements 20. A multiple locking device, not shown, is mounted in mounting hole 73. In the embodiment shown, a multiple locking device lying at right angles to channel 12 would be used. Alternatively, mounting hole 73 may be disposed at the top of holder 70 to provide mounting of a multiple locking device which is permanently disposed in the string of elements 14 as is more fully described below.

Figure 2:
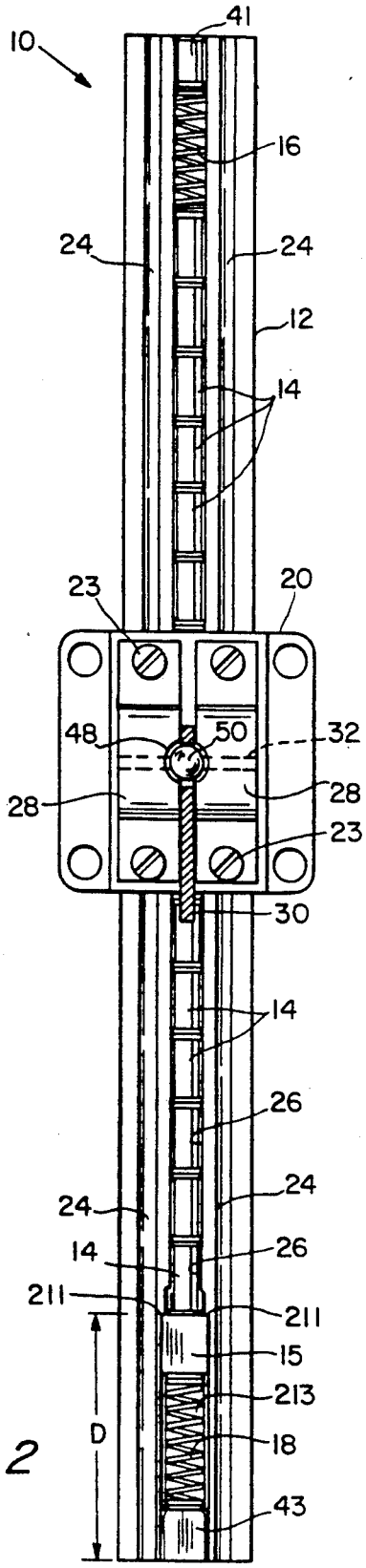
FIG. 2 is a partial cross-sectional front elevational view of the device of FIG. 1.

Actuator driver holder 20 and channel member 12 are shown in partial cross section in FIG. 2. Screws 23 mount element 20 to channel member 12. Actuator 50 is a spherical element, for example a ball bearing, which is held underneath actuator driver 30 against elements 14. End elements 41 and 43 are fixed in channel 26 to serve as end-stops.

Positive return element 15 is biased against shoulder 211 created by counterboring channel 26 a distance D to form enlarged channel 213. If spring 18 has a diameter larger than channel 26, element 15 is unnecessary; in that case, shoulder 211 would limit the expansion of spring 18 to positively return elements 14 to the same position after each locking/unlocking cycle as is explained below.

The locking and unlocking feature, which may be called interlocking, of locking device 10 is shown in FIGS. 3A and 3B. Actuator driver 30 has recess 46 for engaging actuator 50. A second actuator 51 is shown without its associated actuator driver. In use elements 50 and 51 would be spaced farther apart than shown as there is only one actuator associated with each drawer. In FIG. 3A, actuators 50 and 51 are in the unlocked positions in which they lie outside of the string of elements 14 and adjacent an intersection of two elements. Actuator driver 30 is pivotally mounted to channel member 12, FIG. 1, and engages drawer 59 through L-shaped member 60. Member 60 is attached to drawer 59 with section 62 and includes protruding section 64 having a hole to receive arm 36 of driver 30. Alternatively, member 60 can be deleted and arm 36 can directly engage a suitable drawer.

When drawer 59 is moved from its closed position shown in FIG. 3A to its open position shown in FIG. 3B, actuator driver 30 is pivoted on point 32 by the engagement of section 64, with arm 36. This causes surface 44 to drive actuator 50 between elements 14, which causes the string of elements to spread apart in both directions against the biasing force of springs **16*a* and 18*a*. Since elements 41*a* and 43*a* are fixed, springs 16*a* and 18*a* are thereby compressed. Since actuator 50** is constrained to move in a single plane by actuator drive holder 20, even though spring 16*a* is more stiff in compression than spring 18*a*, elements 14 on each side of actuator 50 move equal distances in opposite directions, toward spring 16*a* and spring 18*a*.

When actuator 50 is thrust into the string of elements in this manner, the remaining actuator 51 no longer lies over an intersection of two elements 14. As a result, actuator 51 cannot be interjected into the string of elements and its associated actuator driver, not shown, cannot move. Because each actuator driver 30 is essentially locked into a drawer, when one drawer is opened and its associated actuator is thrust into the string, the remaining drawers cannot be opened.

When drawer 59 is once again closed, portion 64 of member 60 engages surface 42 of arm 40. This causes driver 30 to rotate on point 32 back to the position shown in FIG. 3A. Because springs 18*a* and 16*a* are exerting biasing force on the string of elements 14, actuator 50 is driven out of the string to rest in cutout 46 as shown in FIG. 3A. This defines the unlocked position of actuator 50.

Enlarged positive return element 15 is made slightly larger in diameter than elements 14. The channel holding the elements is counterbored a distance D, FIG. 2, to fit element 15. The counterbore creates shoulder 211 against which element 15 rests: element 15 cannot move up past its position shown in FIG. 3A. By choosing springs 16*a* and 18*a* such that spring 18*a* exerts more biasing force on elements 14 than spring 16*a* in the unlocked position shown in FIG. 3A, element 15 is biased up into contact with shoulder 211 whenever all the drawers are closed, the actuators are out of the string, and the string of elements is in a contiguous condition. This feature ensures that elements 14 return to exactly the same position each time a drawer is closed to positively position an element intersection exactly below an actuator 50, 51 to provide long term failure-free operation. Without the positive return feature, element return is entirely dependent on the two springs acting against one another. Since the biasing force of one or both springs may change as the device is used and the springs fatigue, or when the springs are exposed to varying temperature changes, the element intersections may not be returned to exactly the same position.

Figures 4A, 4B, 5A, 5B:
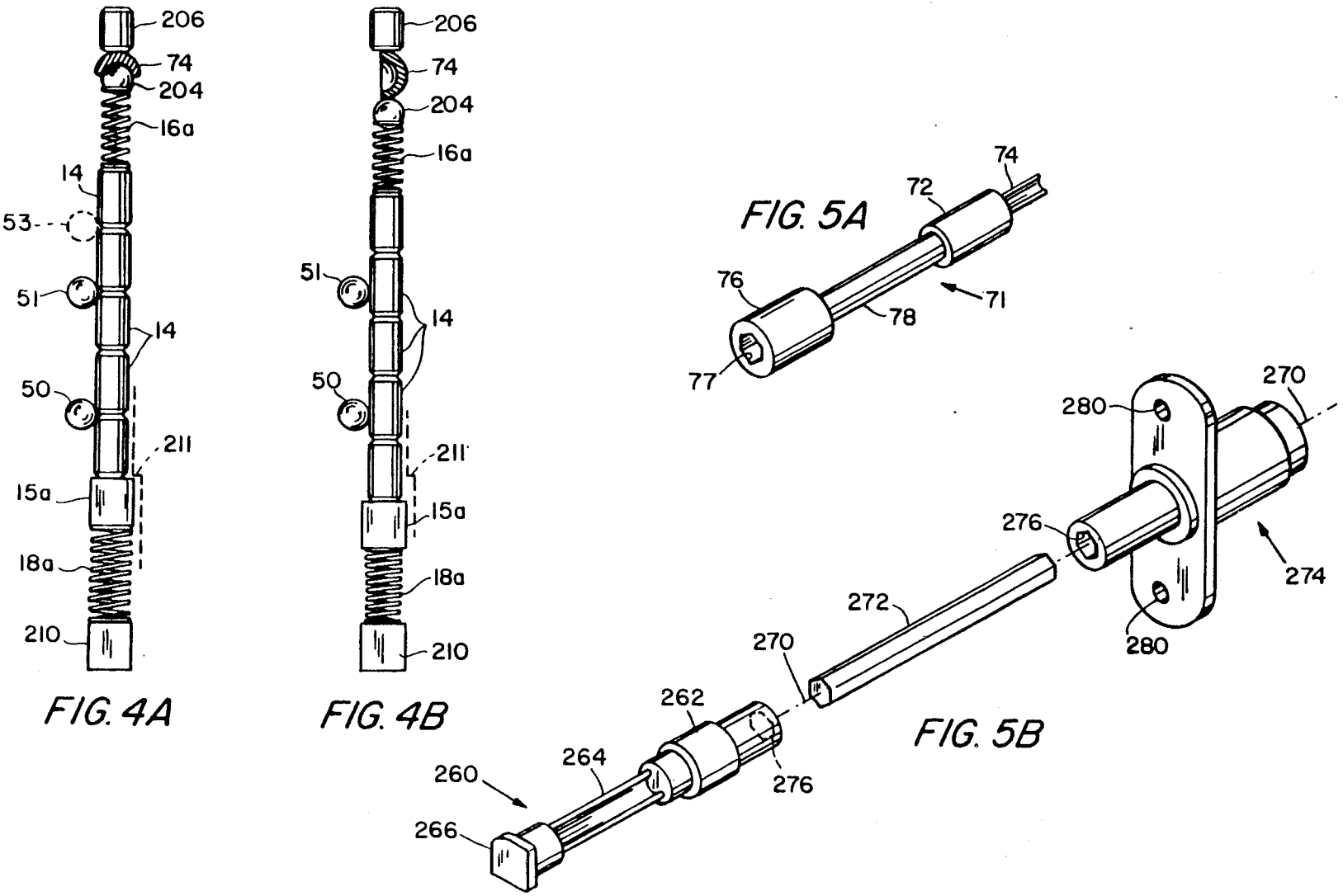
FIGS. 4A and 4B are diagrammatic side elevational views of an embodiment of the multiple locking feature of this invention.
FIG. 5A is an axonometric view of a crescent-shaped rotary locking member for the multiple locking feature of this invention.
FIG. 5B is an exploded axonometric view of another embodiment of the crescent-shaped rotary locking member of this invention along with the rotary lock and flexible shaft used to actuate the rotary locking member.

An embodiment of the multiple locking feature of this invention is shown in FIGS. 4A and 4B. When actuators 50, 51 are in the unlocked position of FIG. 4A, either actuator is poised to be thrust between elements 14 into the locked position. Spring 16*a* may be called the multiple-locking spring and is more stiff in compression than spring 18*a*. In a preferred embodiment, crescent-shaped end 74 of multiple-locking device 71, FIG. 6A, is permanently disposed in the string of elements 14. Spherical multiple locking element 204 rests in the curve of end 74 and against spring 16*a*. End elements 206 and 210 are fixed in position in a channel member, not shown. Enlarged element 15*a* rests against spring 18*a*, which is relatively easily compressed. In the position of FIG. 4A, spring 18*a* is slightly compressed and exerting a biasing force on element 15*a* to bias it against shoulder 211 of the channel member.

Multiple locking of actuators 50 and 51 is shown in FIG. 4B. Crescent-shaped member 74 is turned at, for example, right angles to its orientation of FIG. 4A as shown. The movement need not be 90 degrees, however. Since element 206 is fixed, element 74 pushes ball bearing 204 toward fixed member 210. Since spring 16*a* is very stiff, it compresses a relatively small amount as compared to spring 18*a*. As a result, the entire string of elements 14 moves down toward element 210, causing the element intersections to move out from under actuators 50 and 51 as shown. With the elements in this position neither of the actuators can be thrust between elements, and the devices associated with the actuators, for example the drawer shown in FIGS. 3A and 3B, are held in the closed position. When element 74 is returned to its unlocked position, FIG. 4A, elements 14 are returned to the exact same position as a result of the biasing force of spring 18*a* and the enlarged element 15*a* coming to rest against shoulder 211.

The multiple locking device partially shown in FIGS. 4A and 4B is shown in FIG. 5A. Pin 71 includes crescent-shaped end 74 which is permanently disposed in the string of elements 14 at right angles thereto. Enlarged portion 72 fits in a mounting hole, not shown, which is similar to mounting hole 73, FIG. 1, but aligned at right angles thereto. Cap-head enlarged portion 76 includes hex hole 77 for admitting a hex drive shaft, not shown, which allows pin 71 to be turned from the unlocked position shown in FIG. 4A to the locking position shown in FIG. 4B.

An alternative embodiment of the multiple locking device, designed to fit in holder 73, FIG. 1, is shown in FIG. 5B. Multiple locking device 260 includes crescent-shaped central portion 264 which engages a ball bearing, for example element 53, FIG. 4A, sitting outside of the string of elements adjacent an intersection of elements 14 close to spring 16*a*. Portion 264 has a radius of curvature similar to that of ball bearing 53 so it snugly holds the ball bearing against the string of elements.

The preferred position for multiple locking ball bearing 53, FIG. 4A, is adjacent the last element intersection of the string of elements as shown. When device 260, FIG. 5B, is turned by hex rod 272 disposed in hex-hole 268 of cap-head 262, the ball bearing is thrust between elements, just as actuator 50 or 51 would be, to displace the entire string as shown in FIG. 4B. Device 260 includes enlarged end 266 which may fit in an irregularly shaped mounting hole such as mounting hole 73, FIG. 1, to prevent the inadvertent withdrawal of member 260 from the mounting hole.

Key controlled lock 274, FIG. 5B, is interconnected to multiple locking device 260 by hex rod 272. Hex rod 272 is preferably made from a material which has some longitudinal flexibility but is relatively stiff in relation to torque forces. This material may be an acrylic. Rod 272 fits in hex hole 276 in lock 274 and also in hex hole 268 in cap-head 262, as indicated by common axis 270. Lock 274 is mounted to the outside of a piece of furniture such as a file cabinet by screws, not shown, passed through mounting holes 280. Interconnecting rod 272 allows the locking device to be placed at the back of the file cabinet with lock 274 at its front. Its longitudinal flexibility makes up for any misalignment between lock 274 and locking device 260. Lock 274 may be a key controlled lock or a simple latch as desired, and may be adapted to turn through at least 90 degrees to move multiple locking device 260 between the unlocked and locking positions. The torsional stiffness of rod 272 ensures that lock motion is translated into locking device motion.

Another alternative embodiment of the multiple locking feature of this invention is shown in FIGS. 6A and 6B. Housing 222 of multiple locking device 220 may be attached to channel member 12 with screws 227 as shown. Housing 222 encases drive member 226, which is shown in detail in FIG. 6B. Shaft 228 with enlarged section 230 at one end interconnects lock 232 to drive member 226. Spring 224 is included to return shaft 228 to its unlocked position when lock 232 is unlocked as is more fully described below. Lock 232 is a push-type lock that may be attached to file cabinet wall 236 shown in phantom. Lock 232 may alternatively be attached to a movable member of the cabinet, for example a drawer or door. Because these movable members are not fixed in position to shaft 228, enlarged section 230 is included to provide a large lock contact area to make up for misalignment. In FIG. 6A lock 232 is shown in its unlocked position, with its drive member withdrawn within lock 232. When lock 232 is locked, push rod 234, FIG. 6B, is extended from lock 232 to push shaft 228 toward the locking device.

The functioning of multiple locking device 220 is more clearly shown in FIG. 6B. Drive member 226 includes cylindrical portion 240 which has the same diameter as elements 14 and is aligned with the string of elements adjacent fixed end-stop 242. Drive member 226 and cylindrical member 240 are preferably an integrally molded plastic structure.

Cylindrical driver 244 has a number of fingers 246 protruding from the end disposed against sloped face 227 of drive member 226. Fingers 246 keep drive 244 from withdrawing from housing 222. When shaft 228 is moved to the left by rod 234 as lock 232 is pushed in and locked, member 240 is pushed up in the direction of arrow 241 to displace elements 14 as was shown in FIG. 4B. This misaligns the actuators with an element intersection to prevent their interjection between elements. Cutout 229 in drive member 226 accepts rounded end 231 of driver 244 when the device is in the locking position. Member 226 can be designed to be as large as desired in order to displace elements 14 a sufficient distance to ensure that no element intersection is aligned with an actuator. Preferably, the string is moved a half-element length to ensure failure-free locking.

When lock 232 is unlocked, spring 224 assists in moving shaft 228 to the right in FIG. 6B, thereby allowing springs **16*a* and 18*a* to push element 240 of drive member 226 back to its unlocked position to return elements 14 to their contiguous condition. The multiple locking embodiment shown in FIGS. 6A and 6B provides a larger amount of string movement than the embodiments shown in FIGS. 4 and 5. The increased string movement ensures locking of all the actuators when lock 232 is not fixed in relation to enlarged section 230**, for example when mounted in a drawer or door, and variations are encountered in the relative positions of the lock, locking device, and the drawers.

An embodiment of the means for holding actuator driver 30 in the locking position is shown in FIGS. 7A, 7B, 8A and 8B. Actuator driver 30, FIG. 7B, pivots about pivot pin 32 in actuator driver holder 20. In FIG. 7B, actuator driver 30 is shown in the locking position in which its associated actuator has been thrust between elements as shown in FIG. 3B.

Biasing element 102, FIG. 7A, includes angled section 108 which engages the bottom edge of actuator driver 30. Member 102 includes slot 104 for holding spring 106 between the wall of element 20 and element 102. When actuator driver 30 is moved from its locking position shown in FIGS. 7A and 7B to the unlocked position shown in FIGS. 8A and 8B, member 102 is forced to move to the position shown in FIG. 8A by the downward movement of actuator driver 30. Spring 106 is thereby compressed.

Because actuator driver 30 is interlocked with another structure, for example a drawer, spring 106, FIG. 8A, cannot push element 102 to the left to drive actuator driver 30 to the locking position. When actuator driver 30 is moved to the locking position of FIG. 7B by the opening of its associated drawer, spring 106 pushes element 102 to the left and holds it in the position shown in FIG. 7A. Spring 106 and element 102 thus serve to hold actuator driver 30 in its locking position to prevent it from being jostled into the unlocked position.

Actuator driver biasing is especially advantageous when actuator driver 30 is used as shown in FIGS. 3A and 3B. When drawer 59 is open, FIG. 3B, actuator driver 30 is in the locking position. If driver 30 somehow slipped back to its unlocked position shown in FIG. 3A, its associated drawer could not be fully closed because element 64 would hit arm 36 instead of arm 40. The file cabinet would then have to be disassembled to provide access to the locking device to reset actuator driver 30 to its locked position.

Although specific features of the invention are shown in some drawings and not others, this is for convenience only as each feature may be combined with any or all of the other features in accordance with the invention.

Other embodiments will occur to those skilled in the art and are with the following claims:

What is claimed is:

1. A locking device, comprising:

a plurality of small, discrete elements;

means for confining said elements in a string;

primary and secondary biasing means at opposite ends of said string for biasing said elements into a contiguous series with each adjacent pair meeting at a junction;

a plurality of actuator means each having a first unlocked state and a second locked state;

each said actuator means in its first unlocked state being poised adjacent a junction of said string and in its second, locked state being interjected into its adjacent junction for shifting the remainder of said elements against the force of said biasing means to misalign all of the remaining junctions with respect to the remaining actuators and prevent said remaining actuators from moving into said locked state;

said biasing means returning all said elements to said contiguous series when said actuator means in said locked state is returned to said unlocked state; and means for realigning a junction with each of said actuator means to allow any of said actuator means to be moved to said locked state.

2. The locking device of claim 1 in which said biasing means includes primary and secondary axially compressible elements aligned with said string.

3. The locking device of claim 2 in which said primary compressible element is more stiff in compression than said secondary compressible element.

4. The locking device of claim 3 in which said secondary compressible element exerts more biasing force on said string than said primary compressible element when said string elements are in said contiguous series.

5. The locking device of claim 1 in which said means for realigning includes stop means for fixing the position of said secondary biasing means when said string elements are in said contiguous series to return said junctions to alignment with said actuator means.

6. The locking device of claim 1 further including means for displacing said junctions adjacent said actuator means, when said elements are in said contiguous series, so none of said actuator means are aligned with a junction to prevent any of said actuator means from being moved to said locked state.

7. The locking device of claim 6 in which said means for displacing said junctions includes means for displacing said primary biasing means toward said secondary biasing means.

8. The locking device of claim 7 in which said means for displacing said primary biasing means includes a rotary drive member disposed in said string proximate said primary biasing means.

9. The locking device of claim 8 further including driver means attached to said rotary drive member for rotating said drive member to displace said primary biasing means.

10. The locking device of claim 9 in which said driver means is attached to said drive member by a flexible shaft member for accounting for misalignment between said driver means and said drive member.

11. The locking device of claim 6 in which said means for displacing includes a rotary drive member including a crescent-shaped member and a spherical element adjacent an element intersection proximate said primary biasing means, said crescent-shaped member driving said spherical element between string elements when said drive member is rotated to displace said junctions adjacent said actuator means.

12. The locking device of claim 7 in which said means for displacing said primary biasing means includes a drive member partially disposed in said string and projecting from said string at an angle thereto.

13. The locking device of claim 12 in which said means for displacing further includes a shaft member disposed substantially perpendicularly to said string for engaging said drive member.

14. The locking device of claim 13 further including means for displacing said shaft member toward said string to displace said drive member toward said secondary biasing means.

15. The locking device of claim 14 in which said means for displacing said shaft member includes key-controlled lock means proximate the end of said shaft member spaced from said drive member.

16. The locking device of claim 15 in which said lock means is fixed in relation to said shaft member.

17. The locking device of claim 15 in which said lock means is movable in relation to said shaft member.

18. A drawer locking device for preventing the opening of more than one drawer in a multi-drawer structure comprising:

of small, discrete elements;

means for confining said elements in a string;

primary and secondary biasing means at opposite ends of said string for biasing said elements into a contiguous series with each adjacent pair meeting at a junction;

an actuator means associated with each drawer, each said actuator means in an unlocked state when its associated drawer is closed and a locked state when its associated drawer is open;

each said actuator means in its unlocked state being poised adjacent a junction and in its locked state being interjected into its adjacent junction for shifting the remainder of said elements in both directions against the force of said biasing means to misalign all of the remaining junctions with respect to the remaining actuators and prevent said remaining actuator means from moving to said locked state to hold the rest of the drawers closed;

said actuator means in said locked state returning to said unlocked state when its associated drawer is closed, said biasing means thereby returning said elements to said contiguous series; and means for realigning a junction with each of said actuator means to allow any of said actuator means to be moved to said locking position and thereby allow any one of the drawers to be opened.

19. The drawer locking device of claim 18 further including an actuator drive member associated with each said actuator, each said actuator drive member coupling a drawer to an actuator means for interjecting said actuator means when the drawer is opened.

20. The drawer locking device of claim 19 in which said actuator drive members are pivotally attached to said means for confining at spaced positions along said string.

21. The drawer locking device of claim 20 in which said actuator drive members pivot from a first position to a second position when the associated drawer is opened.

22. The drawer locking device of claim 21 further including biasing means for holding said actuator drive members in said second position.

23. The drawer locking device of claim 21 in which said actuator drive member includes a bifurcated member, one arm of said birfurcated member engaging a drawer on the opening of the drawer and a second arm of said bifurcated member engaging the drawer when it is closed.

* * * * *